US005971106A

United States Patent [19]

Brown et al.

[11] Patent Number: 5,971,106

[45] Date of Patent: Oct. 26, 1999

[54] STEP LADDER

[76] Inventors: Kevin T. Brown, 2536 E. Elsiena Way, Anaheim, Calif. 92806; Randolfp Caravantes, 245 S. Virginia Ave., Burbank, Calif. 91506

[21] Appl. No.: 09/031,468

[22] Filed: Feb. 26, 1998

[51] Int. Cl.[6] ..... E06C 1/36

[52] U.S. Cl. ..... 182/206; 182/86; 182/95; 182/127

[58] Field of Search ..... 182/86, 91, 93, 182/95, 127, 156, 206; 4/494, 538, 555, 576.1, 577.1, 589, 592

[56] References Cited

U.S. PATENT DOCUMENTS

| | | | |
|---|---|---|---|
| 104,569 | 6/1870 | Floyd | 182/206 |
| 2,851,312 | 9/1958 | Hoff | 182/206 |
| 3,006,434 | 10/1961 | Rich | 182/206 |
| 3,169,503 | 2/1965 | Lane | 182/206 |
| 3,448,468 | 6/1969 | Murcott | 4/589 X |
| 3,498,410 | 3/1970 | Storch | 182/206 |
| 3,968,524 | 7/1976 | Zentman | 4/555 X |
| 4,431,082 | 2/1984 | Bott | 182/127 |
| 4,541,507 | 9/1985 | Gibellato | 182/86 |
| 4,724,925 | 2/1988 | Ritten | 182/206 X |
| 4,733,752 | 3/1988 | Sklar | 182/86 |
| 4,751,982 | 6/1988 | Wolfe | 182/206 X |
| 5,249,315 | 10/1993 | Moylan | 4/577.1 X |

*Primary Examiner*—Daniel P. Stodola
*Assistant Examiner*—Bruce A. Lev

[57] ABSTRACT

A step ladder for mounting on the side of a tub to provide a secure way to reach over a tub to clean the opposing regions and walls of the tub. The step ladder includes a top step having front and back edges, left and right sides, and upper and lower surfaces. A lip member is downwardly extended from the lower surface of the top step. The lip member is positioned adjacent the front edge of the top step. A pair of spaced apart elongate legs are downwardly depended from the lower surface of the top step. Each of the legs is pivotally coupled to the lower surface of the top step so that the legs are pivotable between an deployed position and a collapsed position. When the legs are in the collapsed position, the longitudinal axes of the legs are generally parallel with the lower surface of the top step. A step rung is extended between the legs and spaced apart from the top step.

1 Claim, 2 Drawing Sheets

10

21
31
33
23
32
34
30
24
20
28
40
22
26
12
41

10

26
28
20
30
31
14
41
44
45
40

STEP LADDER

BACKGROUND OF THE INVENTION

1. Field of the Invention

The present invention relates to ladders and more particularly pertains to a new step ladder for mounting on the side of a tub to provide a secure way to reach over a tub to clean the opposing regions and walls of the tub.

2. Description of the Prior Art

The use of ladders is known in the prior art. More specifically, ladders heretofore devised and utilized are known to consist basically of familiar, expected and obvious structural configurations, notwithstanding the myriad of designs encompassed by the crowded prior art which have been developed for the fulfillment of countless objectives and requirements.

Known prior art ladders include U.S. Pat. No. 4,417,361; U.S. Pat. No. 4,896,744; U.S. Pat. No. 4,002,223; U.S. Pat. No. 4,100,628; U.S. Pat. No. 4,887,323; and U.S. Patent No. Des. 331,219.

While these devices fulfill their respective, particular objectives and requirements, the aforementioned patents do not disclose a new step ladder. The inventive device includes a top step having front and back edges, left and right sides, and upper and lower surfaces. A lip member is downwardly extended from the lower surface of the top step. The lip member is positioned adjacent the front edge of the top step. A pair of spaced apart elongate legs are downwardly depended from the lower surface of the top step. Each of the legs is pivotally coupled to the lower surface of the top step so that the legs are pivotable between an deployed position and a collapsed position. When the legs are in the collapsed position, the longitudinal axes of the legs are generally parallel with the lower surface of the top step. A step rung is extended between the legs and spaced apart from the top step.

In these respects, the step ladder according to the present invention substantially departs from the conventional concepts and designs of the prior art, and in so doing provides an apparatus primarily developed for the purpose of mounting on the side of a tub to provide a secure way to reach over a tub to clean the opposing regions and walls of the tub.

SUMMARY OF THE INVENTION

In view of the foregoing disadvantages inherent in the known types of ladders now present in the prior art, the present invention provides a new step ladder construction wherein the same can be utilized for mounting on the side of a tub to provide a secure way to reach over a tub to clean the opposing regions and walls of the tub.

The general purpose of the present invention, which will be described subsequently in greater detail, is to provide a new step ladder apparatus and method which has many of the advantages of the ladders mentioned heretofore and many novel features that result in a new step ladder which is not anticipated, rendered obvious, suggested, or even implied by any of the prior art ladders, either alone or in any combination thereof.

To attain this, the present invention generally comprises a top step having front and back edges, left and right sides, and upper and lower surfaces. A lip member is downwardly extended from the lower surface of the top step. The lip member is positioned adjacent the front edge of the top step. A pair of spaced apart elongate legs are downwardly depended from the lower surface of the top step. Each of the legs is pivotally coupled to the lower surface of the top step so that the legs are pivotable between an deployed position and a collapsed position. When the legs are in the collapsed position, the longitudinal axes of the legs are generally parallel with the lower surface of the top step. A step rung is extended between the legs and spaced apart from the top step.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new step ladder apparatus and method which has many of the advantages of the ladders mentioned heretofore and many novel features that result in a new step ladder which is not anticipated, rendered obvious, suggested, or even implied by any of the prior art ladders, either alone or in any combination thereof.

It is another object of the present invention to provide a new step ladder which may be easily and efficiently manufactured and marketed.

It is a further object of the present invention to provide a new step ladder which is of a durable and reliable construction.

An even further object of the present invention is to provide a new step ladder which is susceptible of a low cost of manufacture with regard to both materials and labor, and which accordingly is then susceptible of low prices of sale to the consuming public, thereby making such step ladder economically available to the buying public.

Still yet another object of the present invention is to provide a new step ladder which provides in the apparatuses and methods of the prior art some of the advantages thereof, while simultaneously overcoming some of the disadvantages normally associated therewith.

Still another object of the present invention is to provide a new step ladder for mounting on the side of a tub to provide a secure way to reach over a tub to clean the opposing regions and walls of the tub.

Yet another object of the present invention is to provide a new step ladder which includes a top step having front and back edges, left and right sides, and upper and lower surfaces. A lip member is downwardly extended from the lower surface of the top step. The lip member is positioned adjacent the front edge of the top step. A pair of spaced apart elongate legs are downwardly depended from the lower surface of the top step. Each of the legs is pivotally coupled to the lower surface of the top step so that the legs are pivotable between an deployed position and a collapsed position. When the legs are in the collapsed position, the longitudinal axes of the legs are generally parallel with the lower surface of the top step. A step rung is extended between the legs and spaced apart from the top step.

Still yet another object of the present invention is to provide a new step ladder that allows a user to safely and easily stand on the side of a tub.

Even still another object of the present invention is to provide a new step ladder that is collapsible to permit convenient storage when not in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
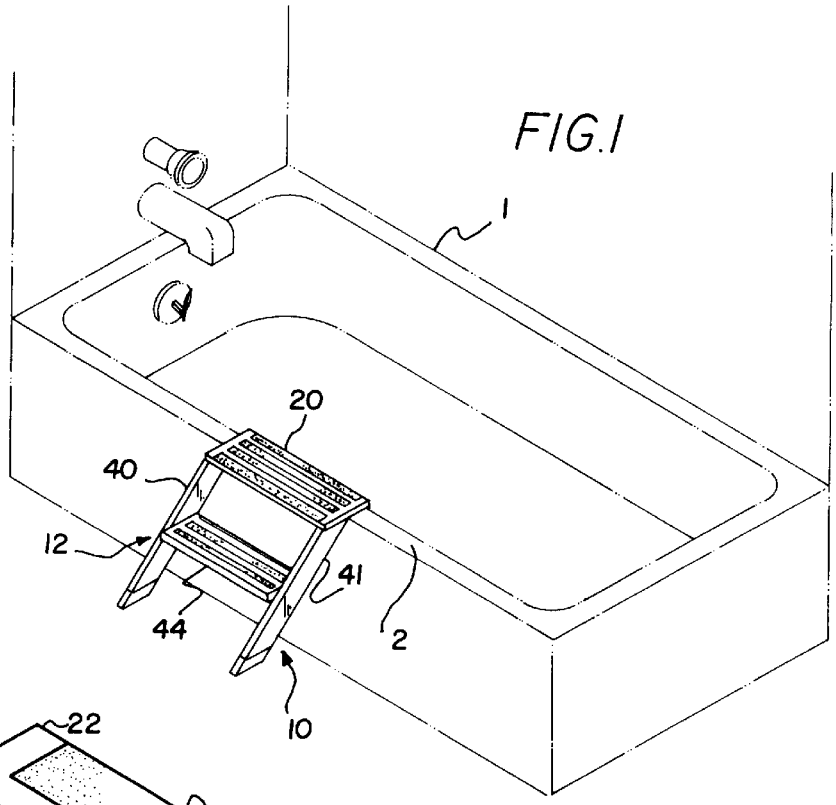
FIG. 1 is a schematic partial perspective view of a new step ladder detailing the lower surface of the top step according to the present invention.

With reference now to the drawings, and in particular to FIGS. 1 through 4 thereof, a new step ladder embodying the principles and concepts of the present invention and generally designated by the reference numeral 10 will be described.

As best illustrated in FIGS. 1 through 4, the step ladder 10 generally comprises a top step 20 having front and back edges 21,22, left and right sides 23,24, and upper and lower surfaces 25,26. A lip member 30 is downwardly extended from the lower surface 26 of the top step 20. The lip member 30 is positioned adjacent the front edge 21 of the top step 20. A pair of spaced apart elongate legs 40,41 are downwardly depended from the lower surface 26 of the top step 20. Each of the legs 40,41 is pivotally coupled to the lower surface 26 of the top step 20 so that the legs 40,41 are pivotable between a deployed position 12 and a collapsed position 14. When the legs 40,41 are in the collapsed position 14, the longitudinal axes of the legs 40,41 are generally parallel with the lower surface 26 of the top step 20. A step rung 44 is extended between the legs 40,41, and spaced apart from the top step 20.

The step ladder 10 is designed for mounting on a side wall 2 of a tub 1. The top step 20 is generally rectangular and has front and back edges 21,22, left and right sides 23,24, and substantially planar upper and lower surfaces 25,26. The lower surface 26 of the top step 20 is designed for resting on the top of a side wall 2 of a tub 1 as illustrate in FIG. 1. Preferably, the upper surface 25 of the top step 20 has traction strips 27 for preventing a user from slipping when stepping on upper surface 25 of the top step 20.

The lip member 30 is also generally rectangular and downwardly extends from the lower surface 26 of the top step 20. The lip member 30 is positioned adjacent the front edge 21 of the top step 20. The lip member 30 is designed for hanging over the top of a side wall 2 of a tub 1. Preferably, a plurality of suction cups 28 are coupled to the lower surface 26 of the top step 20. The suction cups 28 are positioned between the lip member 30 and the back edge 22 of the top step 20. The suction cups 28 are designed for coupling by suction the lower surface 26 of the top step 20 to the top of a side wall 2 of a tub 1.

Figure 2:
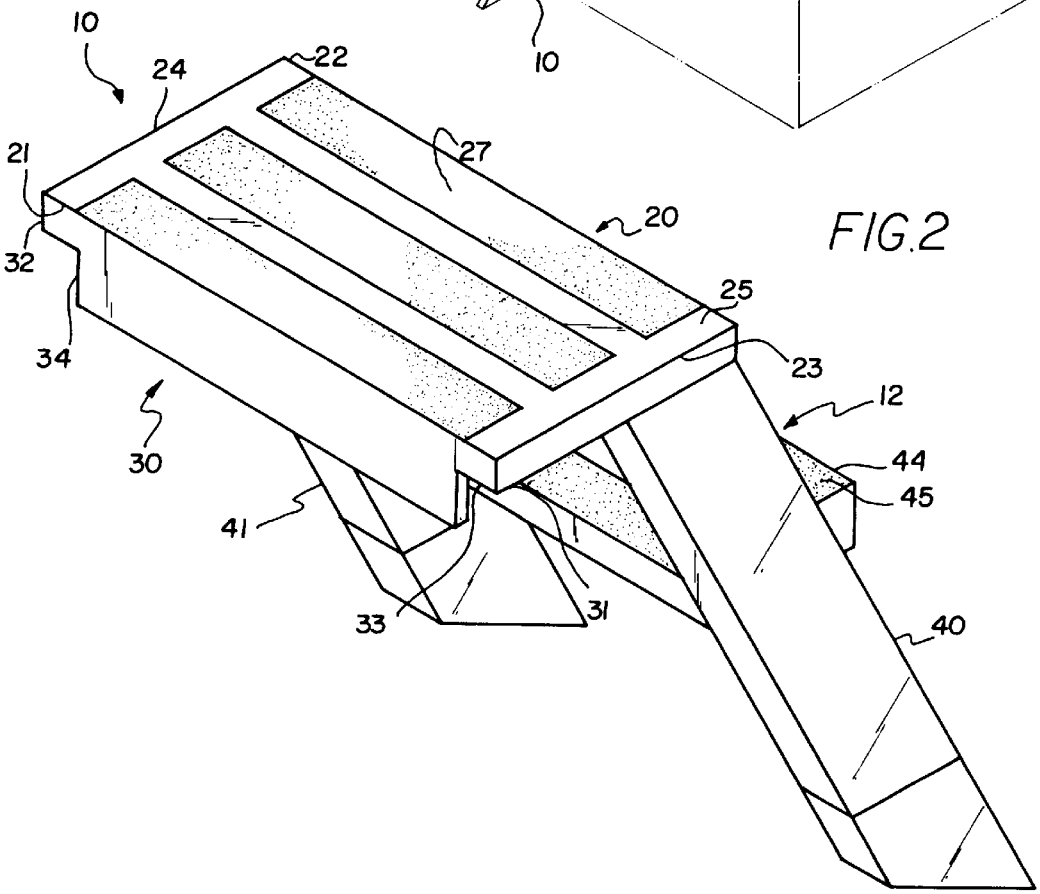
FIG. 2 is a schematic perspective view of the present invention in the collapsed position.
Figure 4:
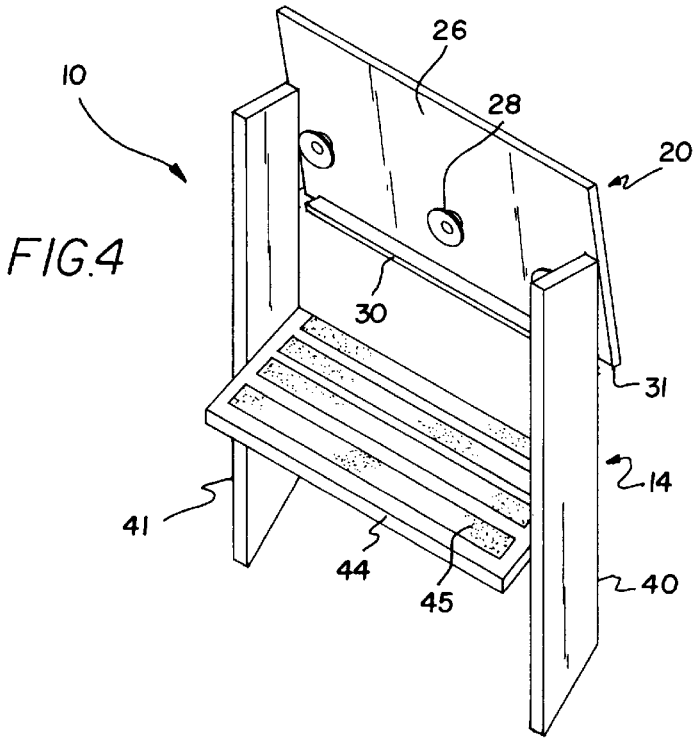
FIG. 4 is a schematic front perspective view of the present invention in the deployed position.

Downwardly depending from the lower surface 26 of the top step 20 are a pair of spaced apart elongate legs 40,41. The legs 40,41 are designed for resting on a ground surface and each of the legs 40,41 is pivotally coupled to the lower surface 26 of the top step 20. The legs 40,41 are pivotable between an deployed position 12 (for resting on the top of a side wall 2 of a tub 1) and a collapsed position 14 (for convenient storage) in relation to the top step 20. As shown in FIG. 4, when in the collapsed position 14, the longitudinal axes of the legs 40,41 (which extends along the length of each leg ) are generally parallel with the lower surface 26 of the top step 20. As illustrated in FIGS. 1 and 2, the longitudinal axes of the legs 40,41 are extended at an angle with respect to the plane of a ground surface when the legs 40,41 are in the deployed position 12.

Figure 3:
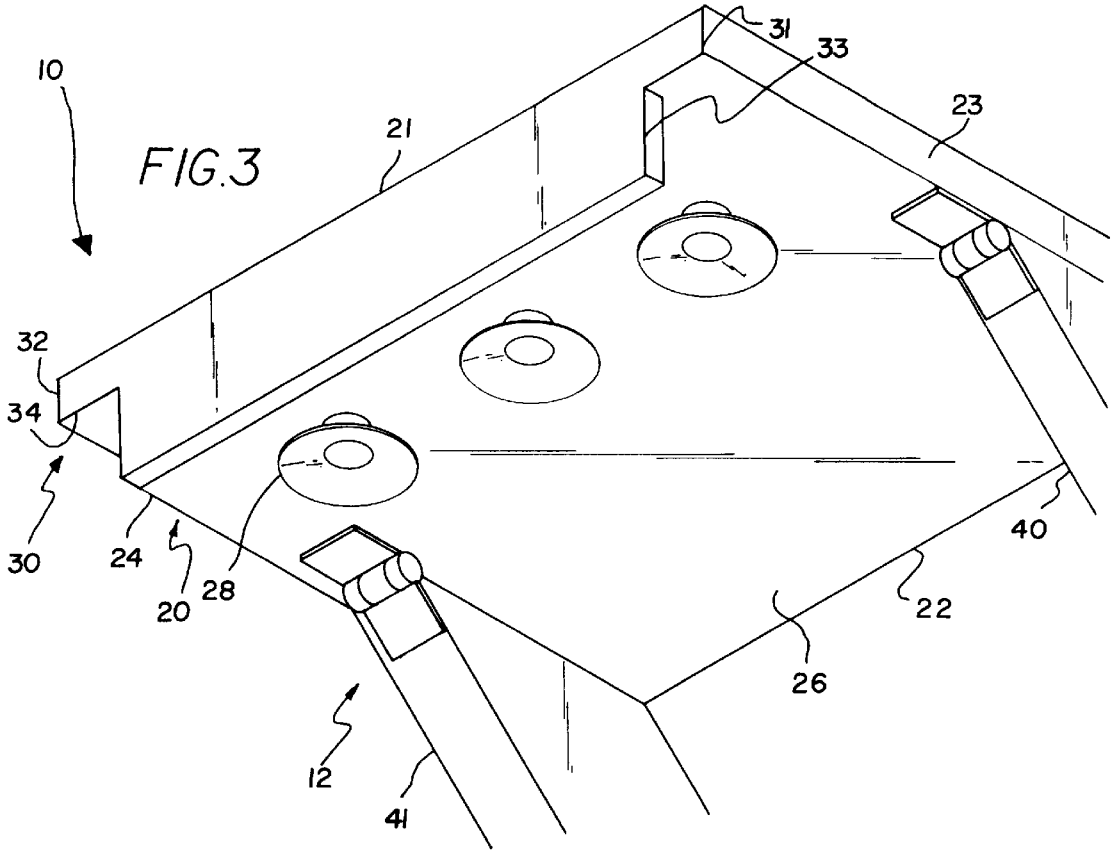
FIG. 3 is a schematic perspective view of the present invention in use.

As best illustrated in FIG. 3, the lip member 30 has opposite side ends 31,32 with the length of the lip member 30 defined between the side ends 31,32. The length of the lip member 30 is extended between the sides 23,24 of the top step 20. In each of the side end 31,32 of lip member 30 is a leg notch 33,34 which are designed for receiving a portion of its respective leg 40,41 when the legs 40,41 are pivoted towards the collapsed position 14.

Preferably, the invention includes a generally planar step rung 44 extending between the legs 40,41. The step rung is spaced apart from the top step 20 and is designed for aiding a person climbing to the top step 20. Ideally, the top surface of the step rung 44 has traction strips 45 for preventing a user from slipping when stepping on the step rung 44.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tub step ladder system, comprising:

a tub having a peripheral sidewall;

a top step being generally rectangular and having front and back edges, left and right sides, and upper and lower surfaces, said top step being positioned on an upper edge of said sidewall of said tub;

a lip member being generally rectangular and being downwardly extended from said lower surface of said top step for engaging an inner surface of said peripheral sidewall of said tub, said lip member being positioned adjacent said front edge of said top step;

a plurality of suction cups being coupled to said lower surface of said top step detachably coupling said top step to said upper surface of said peripheral sidewall of said tub, said suction cups being positioned between said lip member and said back edge of said top step;

a pair of spaced apart elongate legs being downwardly depended from said lower surface of said top step, each of said legs being pivotally coupled to said lower surface of said top step, each of said legs having a longitudinal axis, said legs being pivotable between an deployed position and a collapsed position, wherein said longitudinal axes of said legs are generally parallel with said lower surface of said top step when said legs are in said collapsed position:

said suction cups being positioned between said lip member and said legs;

said lip member having opposite side ends and a length being defined between said side ends of said lip member, said length of said lip member being extended between said sides of said top step, each said side end of lip member having a leg notch, said leg notches being for receiving a portion said legs when said legs are pivoted towards said collapsed position;

a step rung being extended between said legs, said step rung being spaced apart from said top step, said step rung being for aiding a person climbing to said top step;

said top step and said step rung each having a plurality of traction strips coupled to upper surfaces thereof for preventing a user from slipping when stepping on said top step and said step rung;

wherein said traction strips of said top step include inner and outer strips which extend to lateral edges of said upper surface of said top step; and wherein said traction strips of said step rung include inner and outer strips which extend to lateral edges of said upper surface of said step rung.

* * * * *